US006882261B2

(12) United States Patent
Moro et al.

(10) Patent No.: US 6,882,261 B2
(45) Date of Patent: Apr. 19, 2005

(54) COIL-EMBEDDED DUST CORE AND METHOD FOR MANUFACTURING THE SAME, AND COIL AND METHOD FOR MANUFACTURING THE SAME

(75) Inventors: Hideharu Moro, Tokyo (JP); Tsuneo Suzuki, Tokyo (JP)

(73) Assignee: TDK Corporation, Tokyo (JP)

( * ) Notice: Subject to any disclaimer, the term of this patent is extended or adjusted under 35 U.S.C. 154(b) by 49 days.

(21) Appl. No.: 10/350,825

(22) Filed: Jan. 24, 2003

(65) Prior Publication Data

US 2003/0141952 A1 Jul. 31, 2003

(30) Foreign Application Priority Data

Jan. 31, 2002 (JP) ..... 2002-024775

(51) Int. Cl.[7] ..... H01F 5/00
(52) U.S. Cl. ..... 336/200; 336/232; 336/83
(58) Field of Search ..... 336/200, 232, 336/223, 83; 29/602.01

(56) References Cited

U.S. PATENT DOCUMENTS 4,429,314 A * 1/1984 Albright ..... 343/788
5,552,756 A * 9/1996 Ushiro ..... 336/200
6,028,353 A * 2/2000 Nakano et al. ..... 257/701
6,087,922 A * 7/2000 Smith ..... 336/223
6,218,925 B1 * 4/2001 Iwao ..... 336/200
6,278,353 B1 * 8/2001 Downing et al. ..... 336/200
6,362,716 B1 * 3/2002 Anbo et al. ..... 336/200
6,452,473 B1 * 9/2002 Suzuki et al. ..... 336/223
6,476,689 B1 * 11/2002 Uchida et al. ..... 333/177
6,587,025 B1 * 7/2003 Smith et al. ..... 336/200

FOREIGN PATENT DOCUMENTS

| | | |
|---|---|---|
| JP | 04-165605 | 6/1992 |
| JP | 04-286305 | 10/1992 |
| JP | 05-291046 | 11/1993 |
| JP | 11-067553 | 3/1999 |
| JP | 11-273980 | 10/1999 |
| JP | 2000-260623 | 9/2000 |
| JP | 2001-044044 | 2/2001 |
| JP | 2001-267160 | 9/2001 |

* cited by examiner

*Primary Examiner*—Anh Mai
(74) *Attorney, Agent, or Firm*—Hogan & Hartson, LLP

(57) ABSTRACT

There are provided a coil-embedded dust core that provides high inductance and a method for manufacturing the same. The coil-embedded dust core includes a coil 1 formed by winding a flat conductor 2 and a green body 10 comprising of ferromagnetic metal powder coated with an insulating material. The coil 1 is composed of a winding section 3 in which the flat conductor 2 having front and back surfaces opposed to each other with a predetermined distance is wound and lead-out end sections 4*a* and 4*b* that are extended from the winding section 3. Either one of the front and back surfaces of the lead-out end section 4*a* and either one of the front and back surfaces of the lead-out end section 4*b* are formed so as to be on the same plane. By using the coil 1 in which the both end sections (lead-out end sections 4*a* and 4*b*) are formed on the same plane, the coil-embedded dust core can be made smaller in size, and high inductance can be provided.

14 Claims, 11 Drawing Sheets

CROSS SECTION BEFORE WINDING

CROSS SECTION AFTER WINDING

COIL-EMBEDDED DUST CORE AND METHOD FOR MANUFACTURING THE SAME, AND COIL AND METHOD FOR MANUFACTURING THE SAME

BACKGROUND OF THE INVENTION

1. Field of the Invention

The present invention relates to a coil-embedded dust core, which may be used in inductors having a unitary structure with a magnetic core and in other electronic components. The present invention also relates to a method for manufacturing the coil-embedded dust core.

2. Description of the Related Art

In recent years, electric and electronic equipment has become more compact, and dust cores that are compact (low in height) yet able to accommodate large current have come to be in demand.

Materials used for dust cores are ferrite powder and ferromagnetic metal powder, but ferromagnetic metal powder has larger saturation magnetic flux density than ferrite powder and its DC bias characteristics may be maintained even in a strong magnetic field. Consequently, in making a dust core that can accommodate large current, using ferromagnetic metal powder as a material for dust core has become mainstream.

In addition, in order to further the effort to make the core more compact (lower in height), a coil body in which a coil and compacted magnetic powder form a unitary structure has been proposed. In the present specification, an inductor having such a structure may be called a "coil-embedded dust core."

A manufacturing method for a surface-mount type inductor having a structure of a coil-embedded dust core has been proposed in the past. For example, Japanese Patent Laid-Open No. 5-291046 discloses that an exterior electrode is connected to an insulation-coated conduction wire, and these are enclosed in magnetic power, which is then compressed into a magnetic body. In this case, connection parts are inside the magnetic body, which makes them prone to failures while compressing. In the present specification, a "connection part" refers to a part where components are electrically connected to each other, and a part where a component is connected to an external electrode is called a "terminal section."

Japanese Patent Laid-Open No. 11-273980 discloses a method of compression-forming flat powder and a coil using a binder. As an example of the publication, there is disclosed, the steps of making a composite material using a Fe—Al—Si metal alloy powder with an aspect ratio of approximately 20 and a silicone resin as an insulating material, and compression-forming the composite material together with a coil. However, no consideration has been given to connection parts between the coil and terminal sections, and joint failures (including poor joining) are likely to occur due to the fact that joining is difficult since it takes place between the magnetic body section and an electrode at the interface with the core.

Furthermore, a method of manufacturing an inductor using ferrite as a magnetic material is disclosed in Japanese Patent No. 2958807. Here again, part of the terminal that forms a connection part with the coil is inside the core, which makes it prone to failures in the connection parts during the process to form a unitary structure. Japanese Patent No. 3108931 describes a method of manufacturing an inductor by compression-forming while having a coil and a terminal section vertically interposed in a green body. Failures are likely to occur in the connection parts in this case as well.

As stated above, a coil-embedded dust core has a structure in which large inductance can be obtained in spite of its small size. However, as electric and electronic equipment becomes rapidly more compact, the demand for improved quality of coil-embedded dust core is growing. Specifically, there are demands to prevent joint failures between a coil and terminal sections; to prevent insulation failures of a coil and terminal sections with respect to magnetic powder; to make components even more compact; and to have larger inductance.

The coil-embedded dust core or the inductor proposed in the above-described Japanese Patent Laid-Open Nos. 5-291046 and 11-273980, Japanese Patent Nos. 2958807 and 3108931 can be improved in terms of quality. Namely, the coil-embedded dust core or the inductor in Japanese Patent-Laid-Open Nos. 5-291046 and 11-273980, and Japanese Patent No. 2958807 has a coil and terminal sections embedded within magnetic powder, which makes it prone to joint failures between the coil and the terminal sections or insulation failures of the coil and the terminal sections with respect to the magnetic powder. When a joint failure or an insulation failure occurs, it is difficult to determine the cause of the failure and in many cases takes a long time, since the coil and the terminal sections form connection parts inside the magnetic powder.

Furthermore, the inductor described in Japanese Patent No. 3108931 entails a high possibility for a joint failure to occur in connection parts between a coil and terminal sections after molding, due to the fact that a dust core is made using a coil that already has connection parts formed with terminal sections. When a joint failure occurs in a connection part, determining the cause is difficult and time-consuming.

SUMMARY OF THE INVENTION

In view of the above, it is an object of the present invention to provide a coil-embedded dust core that is not prone to joint failures between a coil and terminal sections or to insulation failures of the coil and terminal section with respect to magnetic powder; that is more compact; and that can provide larger inductance; and to provide a method for manufacturing such a coil-embedded dust core.

The inventors have found that by using a coil that is formed by winding a flat conductor and both end sections thereof are formed on the same plane, a coil-embedded dust core can be made more compact while exhibiting larger inductance. That is to say, the present invention provides a coil-embedded dust core comprising a coil including a winding section in which a flat conductor having front and back surfaces opposed to each other with a predetermined distance, is wound; a first end section which is formed by the conductor and is extended from the winding section; and a second end section which is formed by the conductor and is extended from the winding section at a position different from the first end section, with the winding section being insulation coated, and a green body which is formed of insulation-coated ferromagnetic metal particles and in which the coil is embedded, wherein either one of the front and back surfaces of the first end section and either one of the front and back surfaces of the second end section are formed so as to be on the same plane.

In the coil-embedded dust core in accordance with the present invention, the conductor can be formed by a rectangular wire. Also, a part or the whole of each of the first and second end sections is preferably flattened by pressing. Further, the first and second end sections are preferably extended substantially in parallel with the conductor in the winding section. Also, in the coil-embedded dust core in accordance with the present invention, at least one of the first and second end sections has a bent section having a predetermined angle with respect to the winding section. In short, by this bent section, both of the end sections of the coil can be positioned on the same plane. Also, the ferromagnetic metal particles forming the green body are preferably composed of an Fe—Ni system alloy. Since the Fe—Ni system alloy has excellent workability, by making the ferromagnetic metal particles forming the green body an Fe—Ni system alloy, the green body can be made with a relatively low pressurizing force.

Furthermore, the present invention provides a coil-embedded dust core comprising a green body formed of ferromagnetic metal particles coated with an insulating material and a coil which is embedded in the green body, wherein the coil includes a winding section in which a flat conductor being insulation coated, is wound; and a pair of terminal sections formed by extending the conductor forming the winding section, and distances from a predetermined reference plane to the paired terminal sections are made substantially equal. Here, the predetermined reference plane can be the lowermost layer or the uppermost layer of the winding section or an intermediate layer of the winding section, for example. Also, a part or the whole of each of the paired terminal sections of the coil-embedded dust core according to the present invention is preferably exposed to the outside of the green body. Thereby, joint failure and insulation failure are made less liable to occur because a connection part lies on the outside of green body. Further, in the coil-embedded dust core according to the present invention the paired terminal sections are preferably extended from the winding section in a direction different from each other. Also, the paired terminal sections may be formed so as to be wider than other sections of the coil.

Also, the present invention provides a method for manufacturing a coil-embedded dust core, comprising a step (a) of charging raw material powder containing, as ingredients, soft magnetic metal powder and an insulating material forming the green body, into a cavity of a die; a step (b) of arranging the coil formed by winding a flat conductor which is insulation coated, in the cavity of the die into which the raw material powder has been charged; a step (c) of further charging the raw material powder into the cavity of the die so as to cover the coil; and a step (d) of compression forming the raw material powder. Here, it is effective that the soft magnetic metal powder forming the green body is Fe—Ni system alloy powder. Since the Fe—Ni system alloy powder has high workability and is easily compression formed, the coil-embedded dust core can be obtained without damaging the coil in the raw material powder. In the coil-embedded dust core in accordance with the present invention, the coil can include a winding section in which a flat conductor having front and back surfaces opposed to each other with a predetermined distance, is wound; a first end section which is formed by the conductor and is extended from the winding section; and a second end section which is formed by the conductor and is extended from the winding section at a position different from the first end section, and either one of the front and back surfaces of the first end section and either one of the front and back surfaces of the second end section can be formed so as to be on the same plane, and after the step (d), the method can further comprise a step (e) of bending the first and second end sections of the coil along the green body. This bending step (e) is especially effective in the case where the coil-embedded dust core is used as a surface mounting terminal section. Also, in the step (b), the whole or a part of each of the first and second end sections of the coil is preferably located on the outside of the cavity of the die. This is because the first and second end sections of the coil function as the terminal section, so that joint failure is less liable to occur at the time of wire connection in the case where the end sections are located on the outside of the green body.

Further, the present invention provides a coil comprising a winding section in which a flat conductor having front and back surfaces opposed to each other with a predetermined distance, is wound; a first end section which is formed by the conductor and is extended from the winding section; and a second end section which is formed by the conductor and is extended from the winding section at a position different from the first end section, wherein either one of the front and back surfaces of the first end section and either one of the front and back surfaces of the second end section are formed so as to be on the same plane. In this coil, the first and second end sections are preferably extended to symmetrical positions with respect to the winding section. This eliminates a need for distinguishing the direction of coil when the coil is handled.

Also, the present invention provides a method for manufacturing a coil, comprising a step of obtaining a winding coil having a pair of terminal sections; and a step of subjecting the paired terminal sections of the obtained winding coil to sizing process in a state in which a predetermined pressing force is applied or immediately after a predetermined pressing force is applied. In the sizing process, the paired terminal sections can be formed into a rectangular shape which is wider than other sections of the coil. In the method for manufacturing a coil in accordance with the present invention, press processing and sizing process are performed substantially at the same time, so that the number of processes required for manufacturing the coil can be decreased. Also, a step of bending either one or both of the paired terminal sections may be performed so that distances from a predetermined reference plane to the paired terminal sections are made substantially equal before or after sizing process or substantially simultaneously with the sizing process.

DETAILED DESCRIPTION OF THE PREFERRED EMBODIMENTS

The present invention is described in detail below with reference to an embodiment shown in the accompanying drawings.

Figure 1:
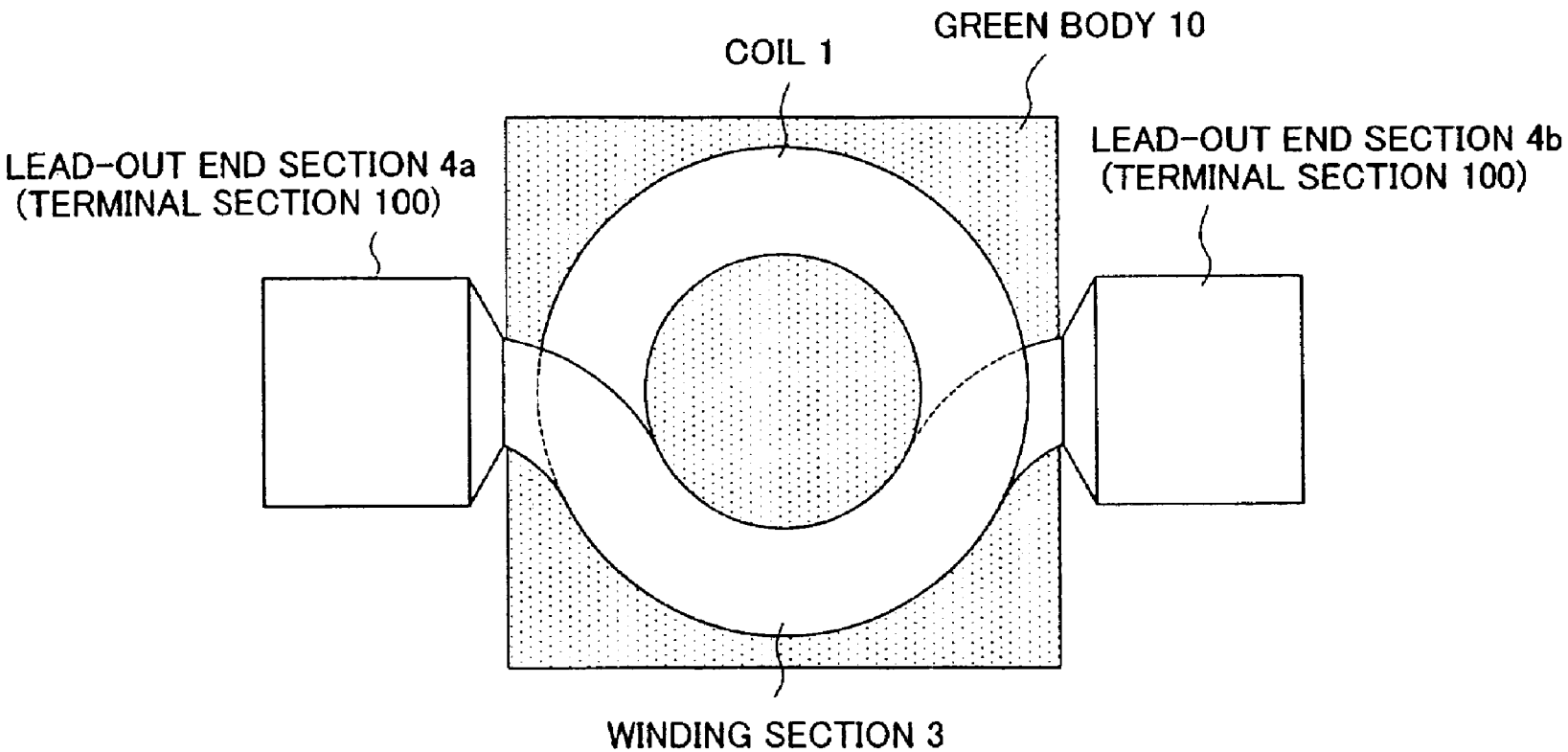
FIG. 1 is a cross-sectional top view of a coil-embedded dust core in accordance with an embodiment.
Figure 2:
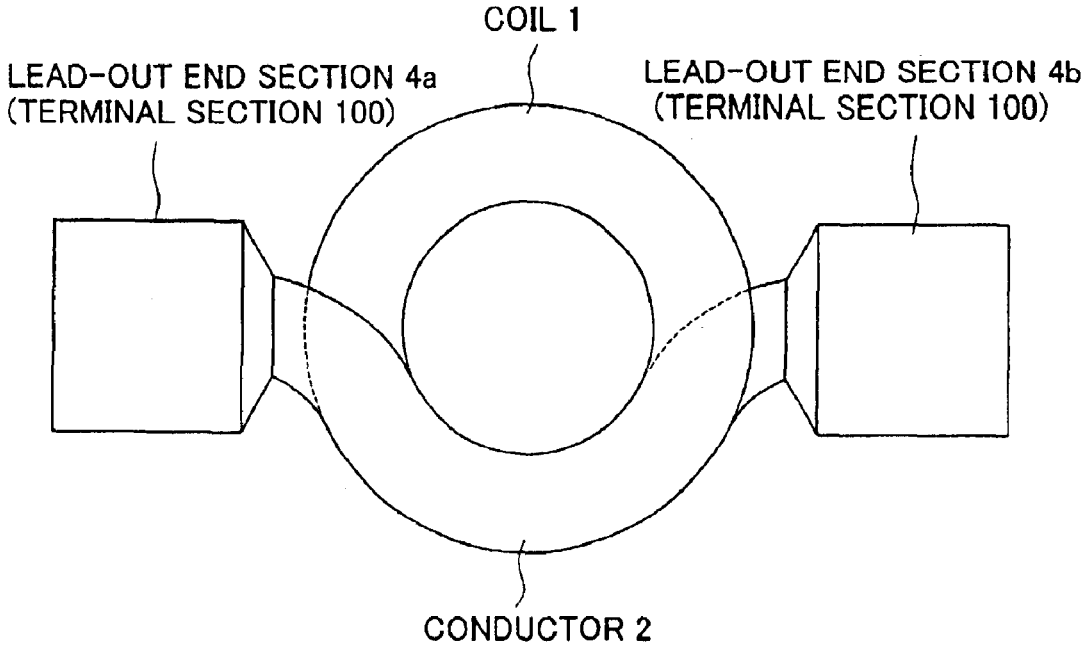
FIG. 2 is a plan view of a coil to be used in an embodiment.

FIG. 1 is a cross-sectional top view of a coil-embedded dust core according to this embodiment. FIG. 2 is a plan view of a coil 1 used in this embodiment, and FIG. 3 is a side view of the coil 1.

Figure 3:
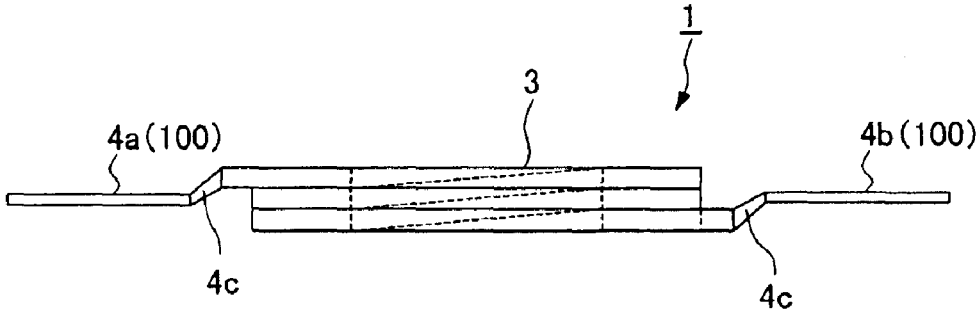
FIG. 3 is a side view of a coil used in an embodiment.

As shown in FIGS. 1 to 3, the coil 1 is an air-core coil including a winding section 3 in which a flat conductor 2 is wound and laminated and lead-out end sections 4*a* and 4*b* each of which is extended from the winding section 3. A green body 10 covers the coil 1 and its circumference except the lead-out sections 4*a* and 4*b* of the coil 1. Although a detailed description is given later, in this embodiment, the coil 1 is of what is called a terminal integrated construction so that the lead-out end sections 4*a* and 4*b* of the coil 1 function as a terminal section 100.

First, the green body 10 is described.

The green body 10 is made by adding an insulating material to ferromagnetic metal powder, mixing them, and thereafter compressing them according to predetermined conditions. Also, it is preferable that after the ferromagnetic metal powder to which the insulating material is added is dried, a lubricant is added to the dried magnetic powder and they are mixed.

As the ferromagnetic metal powder used in the green body 10, single metal powder, two or more kinds of metal powder having a different chemical composition, or alloy powder can be used. The metal powder can be composed of any transition metal element exhibiting soft magnetism or an alloy consisting of a transition metal element and other metal elements. As a concrete example of soft magnetic metal, an alloy composed mainly of one or more kinds of Fe, Co and Ni can be cited. For example, Permalloy (Fe—Ni system alloy, Fe—Ni—Mo system alloy), Sendust (Fe—Si—Al system alloy), Fe—Si system alloy, Fe—Co system alloy, Fe—P system alloy, and the like are preferable. Among these, Permalloy is suitable because of its high magnetic permeability and excellent workability.

When an Fe—Ni system alloy (Permalloy) is selected as ferromagnetic metal powder used in the green body 10, the chemical composition should be 15 to 60 wt % of Fe and 40 to 85 wt % of Ni. Also, an Fe—Ni—Mo system alloy (Permalloy) is selected as ferromagnetic metal powder used in the green body 10, the chemical composition should be 15 to 30 wt % of Fe, 70 to 85 wt % of Ni, and 1 to 5 wt % of Mo.

The shape of particle of ferromagnetic metal powder used in the green body 10 is not limited, but in order to keep the inductance high even in a strong magnetic field, a powder with spherical or elliptical particles is preferably used.

The ferromagnetic metal powder may be obtained by the gas atomizing method, water atomizing method, rotary disk method, etc.

By adding the insulating material, the ferromagnetic metal powder is insulation-coated. The insulating material is properly selected depending on the properties of the magnetic core required, and some of the materials that may be used as an insulating material are various organic polymer resins, silicone resin, phenolic resin, epoxy resin, and water glass; moreover, a mixture of one of these resins and inorganic substances may also be used.

The amount of the insulating material to be added varies depending on the properties of the magnetic core required, but approximately 1 to 10 wt % may be added. When the amount of the insulating material added exceeds 10 wt %, permeability falls and the loss tends to be larger. On the other hand, when the amount of the insulating material added is less than 1 wt %, there is a possibility of insulation failure. A desirable amount of insulating material added is 1.5 to 5 wt %.

The amount of the lubricant to be added may be approximately 0.1 to 1.0 wt %, the amount of the lubricant to be added may preferably be about 0.2 to 0.8 wt %, but the more preferable amount of the lubricant to be added may be about 0.3 to 0.8 wt %. When the amount of the lubricant added is less than 0.1 wt %, removing the die after molding becomes difficult and cracks on the molded product are more likely to occur. On the other hand, when the amount of the lubricant added exceeds 1.0 wt %, density falls and permeability decreases.

The lubricant should be selected from among, for example, aluminum stearate, barium stearate, magnesium stearate, calcium stearate, zinc stearate and strontium stearate. Using aluminum stearate as the lubricant is desirable, due to the fact that its so-called spring back is small.

In addition, a predetermined amount of a cross-linking agent may be added to the ferromagnetic metal powder. Adding the cross-linking agent does not deteriorate the magnetic properties of the green body 10, and instead increases its strength. The amount of the cross-linking agent to be added may preferably be 10 to 40 wt % to the insulating material such as silicone resin. The cross-linking agent may be organic titanium compounds.

Next, the construction of the coil 1 is described with reference to FIGS. 2 and 3.

As shown in FIGS. 2 and 3, the coil 1 is formed by having the conductor 2 wound 2.5 turns in edgewise winding, and the lead-out end section 4*a*, 4*b* of the conductor 2 has a construction such that the conductor 2 is extended from a body section of the coil 1 by inverse forming. That is, the coil 1 is formed integrally without joint.

The cross section of the conductor 2 that forms the coil 1 is flat. Some of the possible flat cross-sectional shapes are rectangular, trapezoidal, or elliptical, for example. The conductor 2 having a rectangular cross section maybe formed by a rectangular wire made of an insulation-coated copper wire. When a rectangular wire is used as the conductor 2, the cross-sectional dimensions may preferably be approximately 0.1 to 1.0 mm long by 0.5 to 5.0 mm wide.

The insulation coating on the conductor 2 may normally be an enamel coating, and the enamel coating thickness may preferably be about 3 $\mu$m.

When the coil 1 is formed by winding the flat conductor 2, the layers of winding that makes up the coil 1 can be brought into very close contact with each other as shown in FIG. 3. Consequently, the electric capacity per cubic volume can be improved as compared with the case where a conductor having a circular cross section is used. In addition, the wire occupation rate can be improved significantly as compared with the case where the coil 1 is formed by winding a conductor whose number of turns is equal but whose cross section is circular. Therefore, the coil 1 made by winding the flat conductor 2 is favorable in making a coil-embedded dust core for a large current.

FIG. 4 shows the cross-sectional shapes of the flat conductor 2 before and after winding.

Figure 4A:
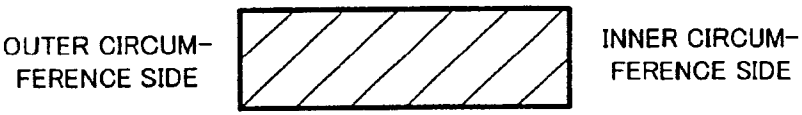
FIGS. 4A to 4D are schematic views showing cross-sectional shapes before and after a flat conductor is wound.
Figure 4B:
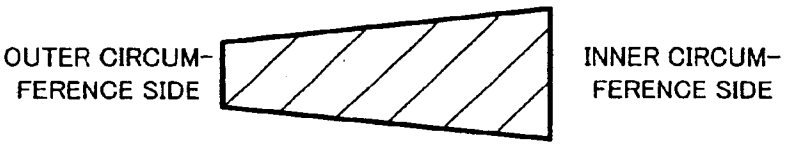

When a rectangular wire is used as the flat conductor 2, the thickness of cross section before winding the conductor 2 is uniform as shown in FIG. 4A. When the conductor 2 is wound from this state, its thickness on the outer circumference side (on the outside of the winding) of the coil 1 becomes smaller than its thickness on the inner circumference side (on the inside of the winding) as shown in FIG. 4B. Here, as described above, the coil 1 is formed by winding the conductor 2 a few turns. When the conductor 2 is wound, the windings eventually come into contact with each other. However, as shown in FIG. 4B, since the thickness of the conductor 2 on the outer circumference side of the coil 1 is made smaller than its thickness on the inner circumference side by winding the conductor 2, an air-core coil can be made by winding the conductor 2 while preventing the coating on the conductor 2 from being peeled off or damaged.

If the coil 1 in which the coating of the conductor 2 has peeled off or suffered damage, were to be embedded within the green body 10, the inductance of coil-embedded dust core would lower remarkably.

Figure 4C:
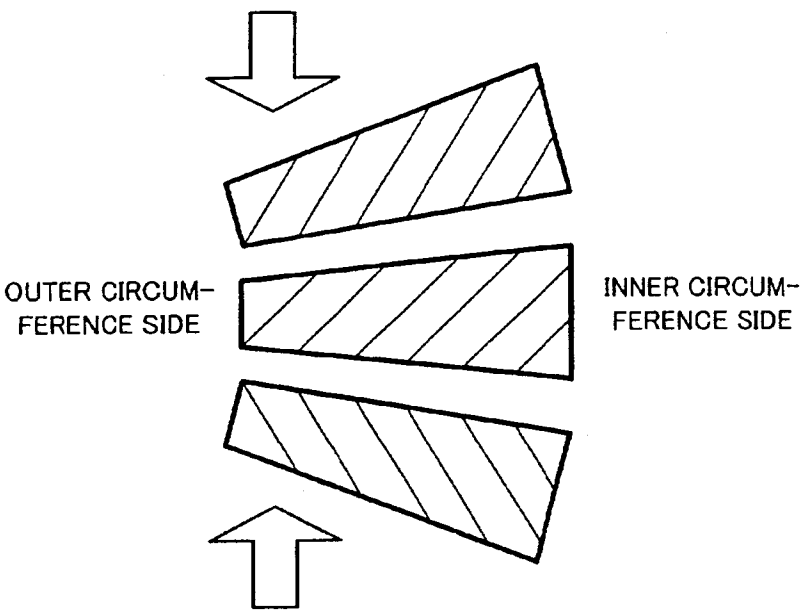
Figure 4D:
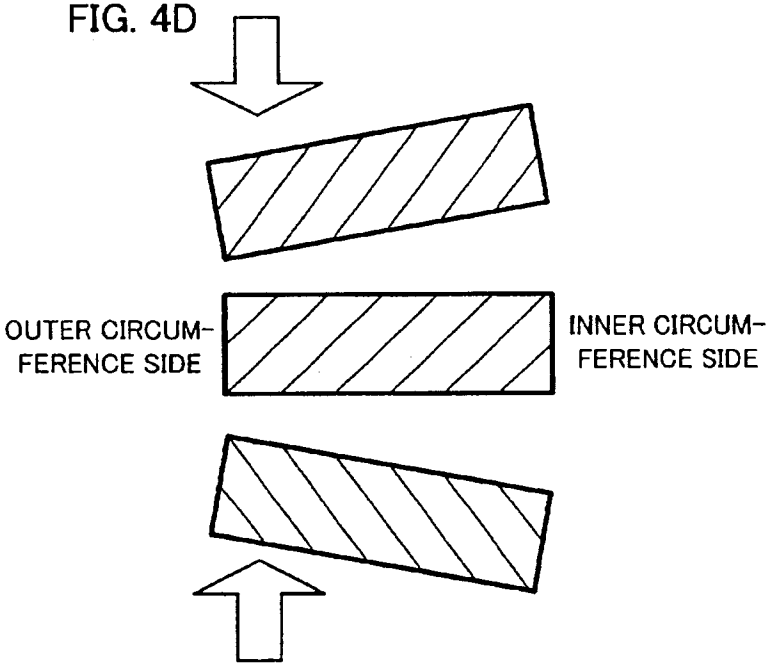

Also, when press processing is rendered in a state in which the flat conductor 2 is wound into a coil and the thickness of the conductor 2 on the outer circumference side of the coil 1 is smaller than its thickness on the inner circumference side as shown in FIG. 4C, the outer circumference side of the coil 1 becomes less prone to damage to the insulation coating. If press processing is rendered in a state in which the thickness of the conductor 2 on the outer circumference side of the coil 1 and the thickness thereof on the inner circumference side are substantially equal as shown in FIG. 4D, the insulation coating on the outer circumference side of the coil is more prone to damage.

Based on the cross-sectional shape of the coil 1 formed after the conductor 2 is wound into a coil, the cross-sectional shape of the conductor 2 may be selected to be trapezoidal or the like when appropriate.

Next, a method for manufacturing the coil 1 in accordance with this embodiment will be described with reference to FIGS. 5 to 8.

Figure 5:
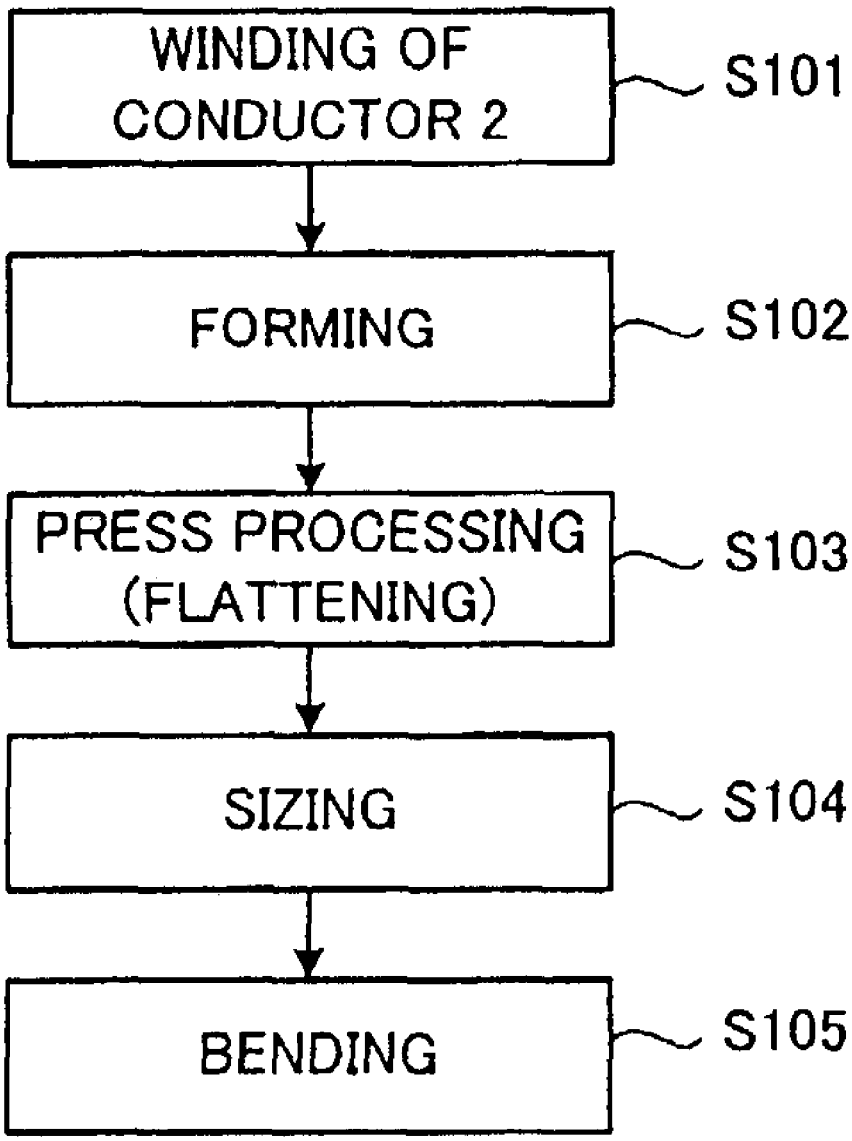
FIG. 5 is a flowchart of a manufacturing process for a coil in accordance with an embodiment.

FIG. 5 is a flowchart showing a process for manufacturing the coil 1 in accordance with this embodiment. As shown in FIG. 5, in the process for manufacturing the coil 1 in accordance with this embodiment, a winding step of the conductor 2 (step S101), a forming step (step S102), a press processing (flattening) step (step S103), a sizing process step (step S104), and a bending step (step S105) are included.

<Winding Step of Conductor 2>

Figure 6A:
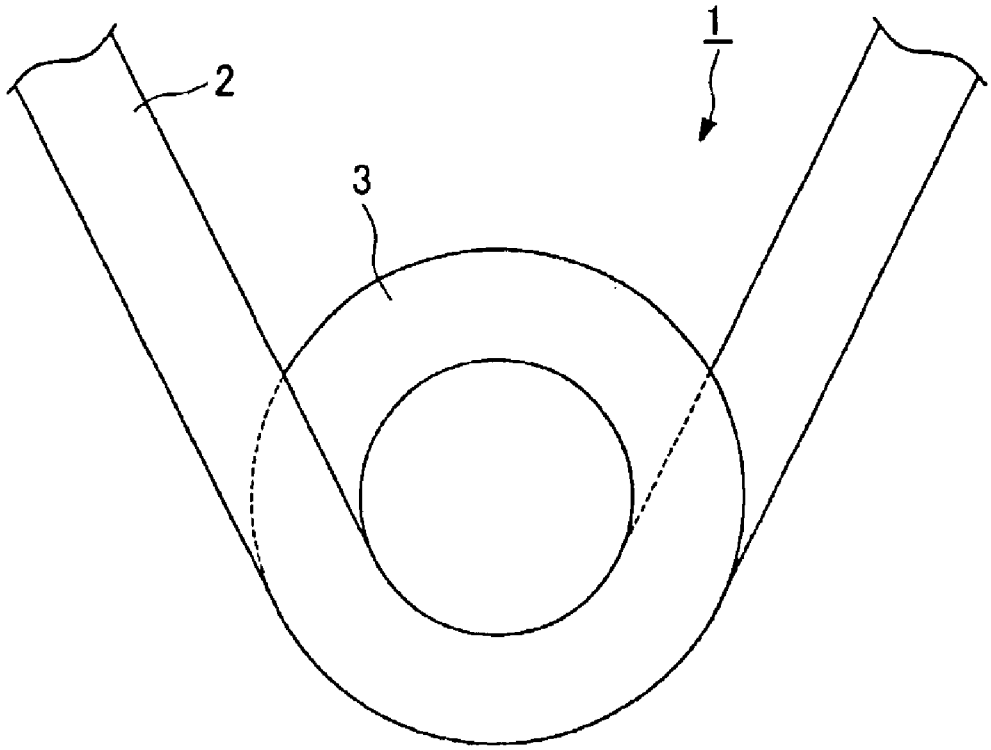
FIGS. 6A and 6B are views for illustrating a winding step.
Figure 6B:
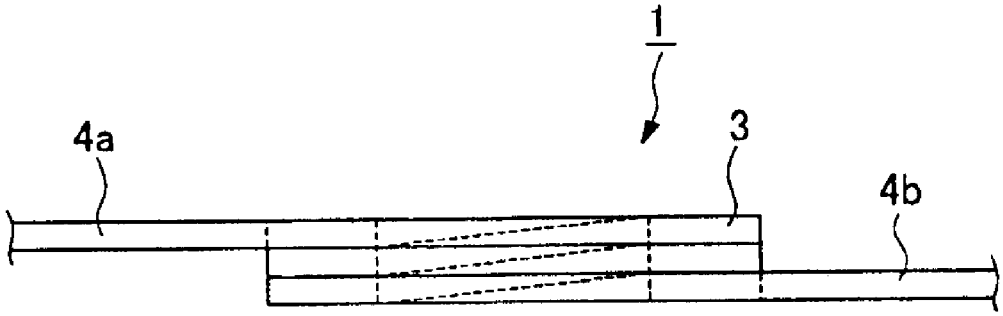

First, in step S101, as shown in FIGS. 6A and 6B, the flat conductor 2 is wound to form the winding section 3 and the lead-out end sections 4*a* and 4*b* of the coil 1. The number of turns of the conductor 2 is set appropriately according to the required inductance, and it can be 1 to 6 turns, preferably 2 to 4 turns. FIG. 6B is a side view of the coil 1 after being wound 2.5 turns in edgewise winding. It is preferable from the viewpoint of decreased number of work processes and improved wire occupation rate that the layers of winding that makes up the coil 1 be brought into very close contact with each other in advance at the stage of winding step in step S101 as shown in FIG. 6B.

<Forming Step>

Figure 7:
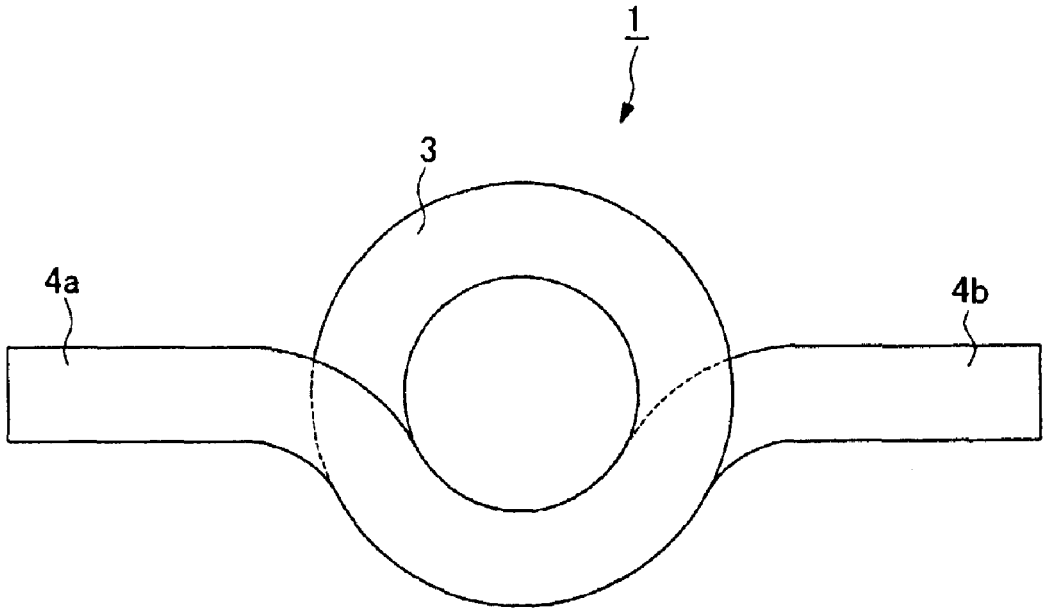
FIG. 7 is a view for illustrating a forming step.

In the succeeding step S102, forming of the coil 1 is performed. FIG. 7 is a plan view showing a state in which the lead-out end sections 4*a* and 4*b* of the conductor 2 are extended from the winding section 3 of the coil 1 by inverse forming. The direction, in which the lead-out end section 4*a* is extended, is preferably a direction different from the direction in which the lead-out end section 4*b* is extended. The reason for this is that if the lead-out end sections 4*a* and 4*b* are extended in the same direction, inconvenience is caused when the lead-out end sections 4*a* and 4*b* are subjected to press processing (the details of press processing is described later), and it is difficult to arrange the coil 1 in the center of the green body 10 when the coil-embedded dust core is manufactured. Also, as shown in FIG. 7, forming is preferably performed so that the lead-out end sections 4*a* and 4*b* are arranged symmetrically. By doing this, when the coil-embedded dust core using the coil 1 is used as a surface mounting part, the extending directions of the lead-out end sections 4*a* and 4*b*, which function as the terminal section 100, can be made symmetrical. Therefore, when the coil 1 is handled, for example, when the coil 1 is placed in a compressing die, the direction of the coil 1 need not be distinguished.

<Press Processing (Flattening by Pressing) Step>

After the forming of the coil 1 has been performed in step S102, the process proceeds to step S103. In step S103, the lead-out end sections 4*a* and 4*b* are subjected to press processing (flattening by pressing; hereinafter referred to as "flattening"). This step is accomplished to cause the lead-out end sections 4*a* and 4*b* of the coil 1 to function as the terminal section 100. Through this step, the plain surfaces of the lead-out end sections 4*a* and 4*b* are formed so as to be wider and thinner than the plain surface of the conductor 2.

The press processing in step S102 is preferably performed so that the thickness of the conductor 2 is about 0.1 to 0.3 mm. As described above, the press processing is performed to form the plain surfaces of the lead-out end sections 4*a* and 4*b* so as to be wider and thinner than the plain surface of the conductor 2. In addition, however, an effect that the strength of the lead-out end sections 4*a* and 4*b* functioning as the terminal section 100 is increased by the press processing can be anticipated.

Figure 8A:
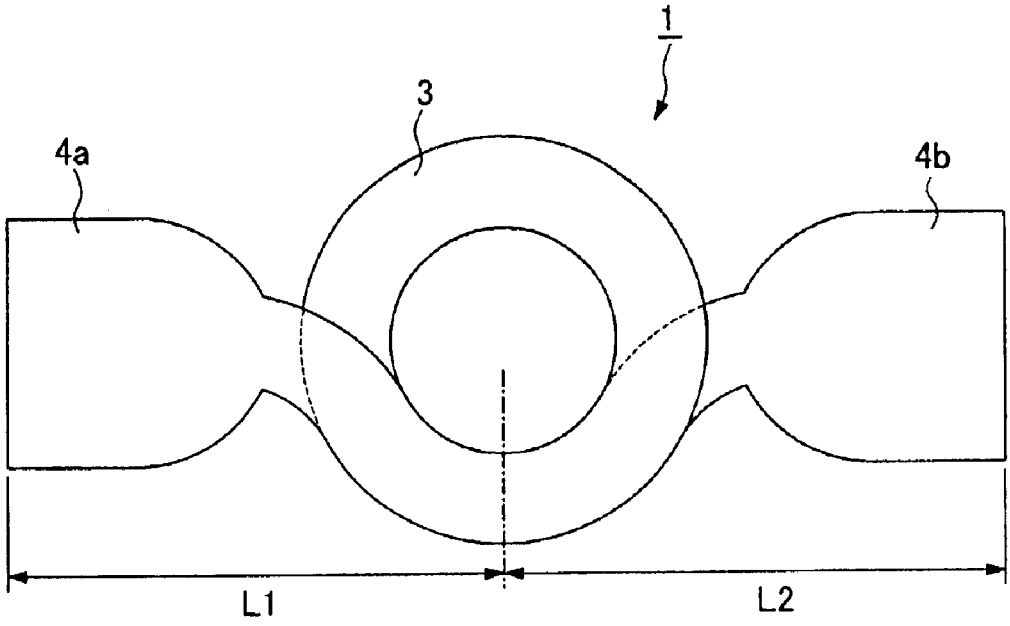
FIGS. 8A and 8B are views for illustrating a press processing step.
Figure 8B:
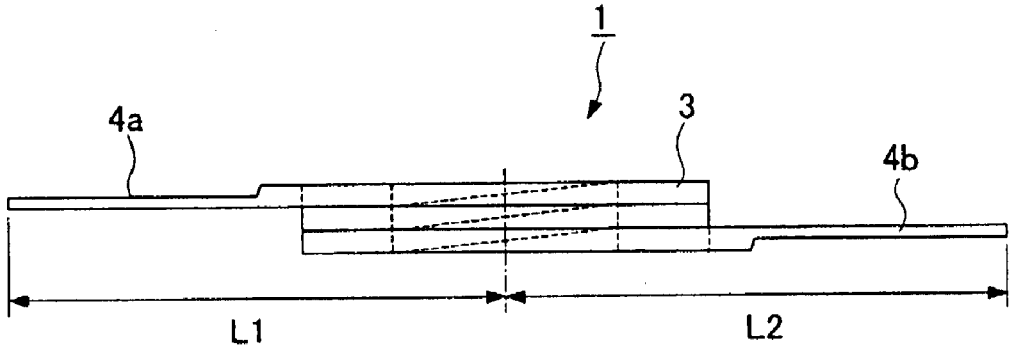

FIG. 8 shows a state after the lead-out end sections 4*a* and 4*b* have been subjected to press processing. FIG. 8A is a plan view of the coil 1, and FIG. 8B is a side view of the coil 1.

As shown in FIG. 8A, when the lead-out end section 4*a*, 4*b* is subjected to press processing, the conductor 2 in this section elongates in an isotropic manner and is formed into a cup shape.

The shape of the lead-out end section 4*a*, 4*b* is preferably rectangular so as to fit to the land pattern of a substrate on which the coil-embedded dust core using the coil 1 is mounted. However, the rectangular shape of the lead-out end section 4*a*, 4*b* is not an essential requirement for making the lead-out end section 4*a*, 4*b* function as the terminal section 100. Therefore, if the size of the lead-out end section 4*a*, 4*b* after being subjected to press processing is such as to fit in the land pattern of substrate, the later-described sizing process can be omitted.

<Sizing Process Step>

After the lead-out end sections 4*a* and 4*b* have been subjected to press processing in step S103, the process proceeds to step S104. In step S104, the press processed lead-out end sections 4*a* and 4*b* are subjected to sizing process. The sizing may be performed by using a cutting die, for example. Since the land pattern of substrate on which the coil-embedded dust core is mounted usually has a rectangular shape, the lead-out end sections 4*a* and 4*b* preferably have a rectangular shape to fit to the land pattern. For instance, when using the coil-embedded dust core in a notebook computer, the shape of the lead-out end section 4*a*, 4*b* may preferably be rectangular with dimensions of approximately 20×30 mm to 50×60 mm. Although the rectangular shape of the lead-out end section 4*a*, 4*b* is not an essential requirement for making the lead-out end section 4*a*, 4*b* function as the terminal section 100 as described above, the requirement for the shape and dimensional accuracy of the terminal section 100 is strong nowadays because of small and narrow land pattern caused by the increase in surface mounting density. Therefore, the press processed lead-out end sections 4*a* and 4*b* are preferably subjected to sizing process. The coil 1 having been subjected to sizing process has a planar shape, for example, as shown in the plan view of FIG. 2.

<Bending Step>

After the lead-out end sections 4*a* and 4*b* have been subjected to sizing process in step S104, the process proceeds to step S105. In step S105, the sizing processed lead-out end sections 4*a* and 4*b* are subjected to bending process. This bending step is characteristic of the present invention. This step is performed to arrange the lead-out end sections 4*a* and 4*b* functioning as the terminal section 100 on the same plane.

Next, the details of the bending step are explained with reference to FIG. 9. FIGS. 9A to 9C are side views of the coil 1.

Figures 9A, 9B, 9C:
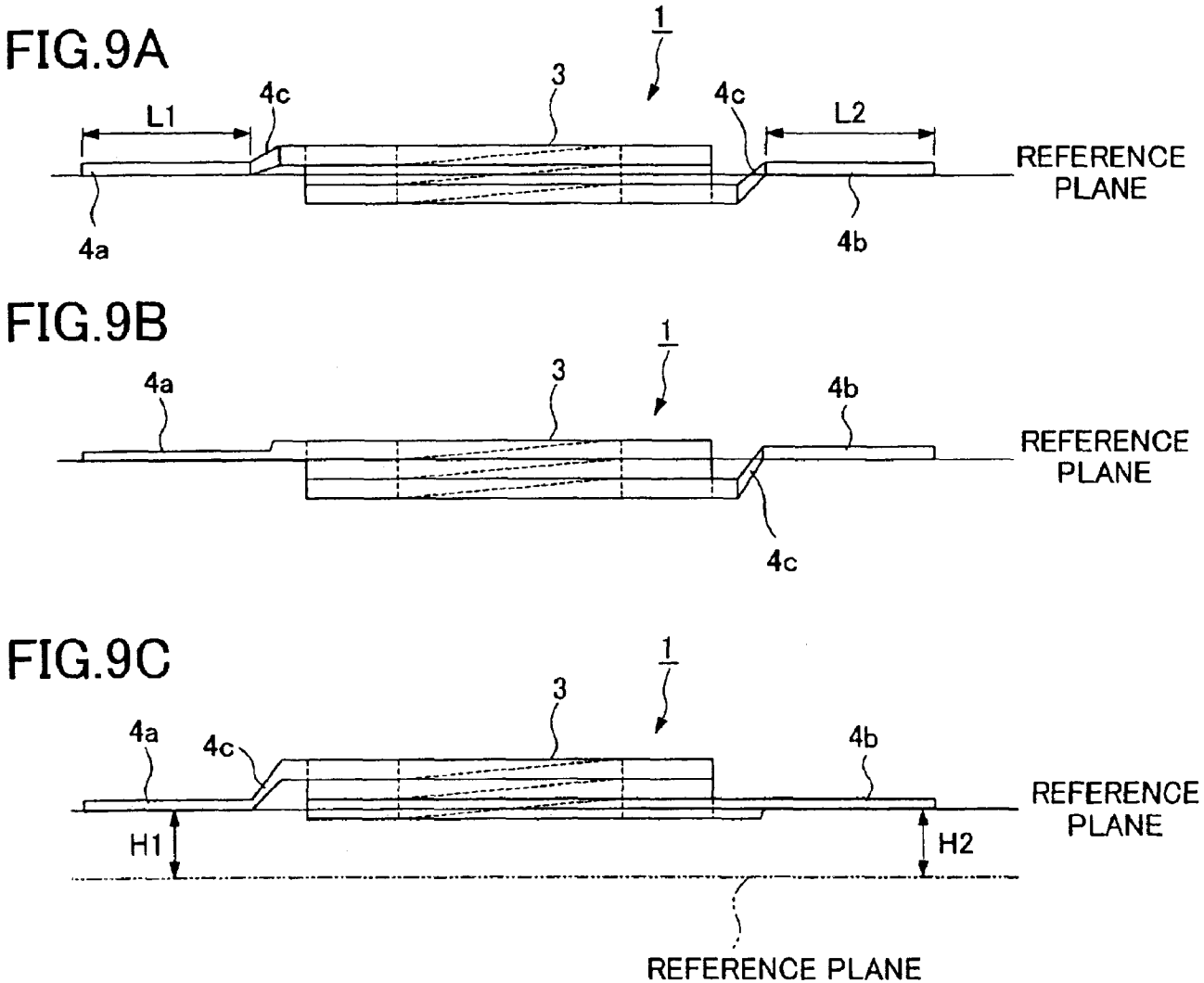
FIGS. 9A to 9C are views for illustrating a bending step.

FIG. 9A is a side view showing a state in which the lead-out end sections 4*a* and 4*b* are arranged on the same plane with an intermediate layer of the winding section 3 being a reference plane. As shown in FIG. 9A, when the intermediate layer of the winding section 3 is made a reference plane, the lead-out end sections 4*a* and 4*b* are bent at an angle by the substantially same amount, and bent sections 4*c* are formed between the lead-out end section 4*a* and the winding section 3 and between the lead-out end section 4*b* and the winding section 3. When the lead-out end sections 4*a* and 4*b* are arranged on the same plane with the intermediate layer of the winding section 3 being a reference plane in this manner, in the above-described sizing process step (step S104), the lengths of the lead-out end sections 4*a* and 4*b* are made approximately equal, that is, a length L1 from the centerline of the winding section 3 of the coil 1 to the tip end of the lead-out end section 4*a* is caused to coincide with a length L2 from the centerline of the winding section 3 of the coil 1 to the tip end of the lead-out end sections 4*b*. Thereby, when the bent sections 4*c* are formed between the lead-out end section 4*a* and the winding section 3 and between the lead-out end section 4*b* and the winding section 3, a length L3 of the lead-out end section 4*a* can be caused to substantially coincide with a length L4 of the lead-out end sections 4*b*.

FIG. 9B is a side view showing a state in which the lead-out end sections 4*a* and 4*b* are formed on the same plane with the uppermost layer of the winding section 3 being a reference plane, that is, they are formed so that either one of the front and back surfaces of the lead-out end section 4*a* and either one of the front and back surfaces of the lead-out end section 4*b* are formed so as to be on the same plane. As shown in FIG. 9B, when the uppermost layer of the winding section 3 is used as a reference plane, only one lead-out end section 4*b* is bent at an angle, by which the bent section 4*c* is formed between the lead-out end section 4*b* and the winding section 3. Also, when the lead-out end sections 4*a* and 4*b* are arranged on the same plane with the lowermost layer of the winding 3 being a reference plane, as shown in FIG. 9C, only one lead-out end section 4*a* may be bent at an angle to form the bent section 4*c* between the lead-out end section 4*a* and the winding section 3.

When the lead-out end sections 4*a* and 4*b* are arranged on the same plane with the uppermost layer of the winding 3 being a reference plane as shown in FIG. 9B, in the above-described sizing process step (step S104), the length of the lead-out end section 4*b* is made longer than the length of the lead-out end section 4*a*. That is, the above-described process of step S101 through step S104 is performed so that the length L2 from the centerline of the winding section 3 of the coil 1 to the tip end of the lead-out end section 4*b* is longer than the length L1 from the centerline of the winding section 3 of the coil 1 to the tip end of the lead-out end section 4*a*. The same is true for the case where the lead-out end sections 4*a* and 4*b* are arranged on the same plane with the lowermost layer of the winding 3 being a reference plane.

When the bent section 4*c* is formed by bending the lead-out end section 4*a*, 4*b*, a portion subjected to flattening may be bent, or a portion not subjected to flattening may be bent. Since the thickness of the lead-out end section 4*a*, 4*b* is 0.1 to 1.0 mm before press processing and 0.1 to 0.3 mm after press processing, the lead-out end sections 4*a* and 4*b* can be bent easily.

The bending step (step S105), which is the step characteristic of the present invention, has been described above with reference to FIG. 9. This step is essential in arranging the lead-out end sections 4*a* and 4*b* on the same plane. That is, in a state in which the bent section 4*c* is not formed in both portions between the lead-out end section 4*a* and the winding section 3 and between the lead-out end section 4*b* and the winding section 3 as shown in FIGS. 6B and 8B, the lead-out end sections 4*a* and 4*b* cannot be arranged on the same plane.

In the above-described embodiment, an example in which the bending step (step S105) is performed after the press processing step (step S103) and the sizing process step (step S104) has been explained. However, the press processing step (step S103) and the sizing process step (step S104) may be performed after the bending step (step S105) has been performed. Also, the bending step (step S105) may be performed between the press processing step (step S103) and the sizing process step (step S104).

Although described later in detail, when the coil 1 in which the lead-out end sections 4*a* and 4*b* are arranged on the same plane as shown in FIGS. 9A to 9C is used, an effect that a high inductance value can be obtained and variations in inductance value can be reduced, is achieved. It is a matter of course that the reference plane is not limited to ones indicated by a solid line in FIGS. 9A to 9C, and a reference plane indicated by an imaginary line in FIG. 9C can be used. In this case, the bent section 4*c* maybe formed so that a distance H1 from the predetermined reference plane to the lead-out end section 4*a* (either one of the front and back surfaces thereof) is approximately equal to a distance H2 from the predetermined reference plane to the lead-out end section 4*b* (either one of the front and back surfaces thereof).

Although the method in which the coil 1 is manufactured by performing the steps of step S101 through step S105 has been described above, the press processing step (step S103) and the sizing process step (step S104) can be performed substantially at the same time. This case where these two steps are performed substantially at the same time includes both a case where the sizing process is performed in a state in which the lead-out end section 4*a*, 4*b* functioning as the terminal section 100 is subjected to a predetermined pressing force and a case where the sizing process is performed immediately after the lead-out end section 4*a*, 4*b* functioning as the terminal section 100 is subjected to a predetermined pressing force. In order to perform the press processing step (step S103) and the sizing process step (step S104) substantially at the same time, for example, the configuration may be such that a cutting die is provided around a punch for press processing, and the cutting die is lowered in the state in which the lead-out end section 4*a*, 4*b* is subjected to the predetermined pressing force or immediately after the lead-out end section 4*a*, 4*b* is subjected to the predetermined pressing force to cut the lead-out end section 4*a*, 4*b* into a predetermined shape.

Further, the press processing step (step S103), the sizing process step (step S104), and the bending step (step S105) can be performed substantially at the same time. That is to say, the coil 1 in the state shown in FIG. 3 can be obtained from the state of coil 1 shown in FIG. 7 by one step. In this case, the bent section 4*c* may be formed in at least one portion between the lead-out end section 4*a* and the winding section 3 or between the lead-out end section 4*b* and the winding section 3 by bending a part of the lead-out end section 4*a*, 4*b* while applying the predetermined pressing force to the lead-out end section 4*a*, 4*b*. Immediately after the bent section 4*c* has been formed, for example, a cutting die is lowered to cut the lead-out end section 4*a*, 4*b* into a predetermined shape. The present invention can be applied to not only the case where a lower core is not preformed but also the case where a lower core is preformed.

Since, as described above, the coil 1 is formed so that the lead-out end sections 4*a* and 4*b* function as the terminal section 100, an independent terminal section need not be provided. That is to say, according to the coil-embedded dust core in accordance with this embodiment, a connection part between the coil and the terminal section is eliminated. The elimination of connection part avoids the conventional problems such as joint failure between the coil and the terminal section and insulation failure of the coil and terminal section with respect to the magnetic powder. Also, since the coil 1 in accordance with this embodiment is an air-core coil that is made by winding a flat conductor 2, high inductance can be provided with a small number of turns, and downsizing (low in height) of core can further be promoted. Further, when the press processing and the sizing process are performed substantially at the same time, the number of processes for making the coil 1 can be decreased, so that the work efficiency is improved. Moreover, when the press processing and the sizing process are performed substantially at the same time, the coil 1 need not be moved, so that the positioning accuracy at the time of sizing process becomes higher than before, by which an increase in the working accuracy of the lead-out end sections 4*a* and 4*b* that function as the terminal section 100 can be anticipated. Still further, for the coil 1 in which the lead-out end sections 4*a* and 4*b* are arranged on the same plane, the inductance varies less, and the performance is high.

Next, a method for manufacturing the coil-embedded dust core in accordance with this embodiment will be described with reference to FIGS. 10 and 11.

Figure 10:
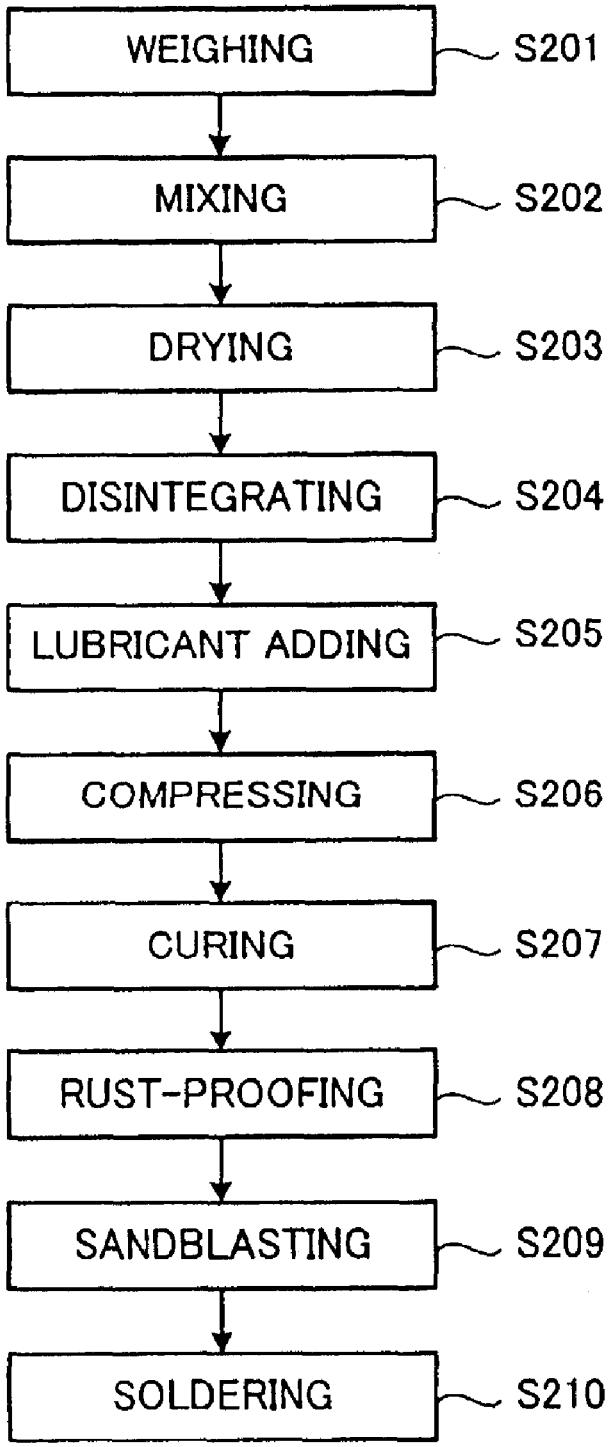
FIG. 10 is a flowchart of a manufacturing process for a coil-embedded dust core in accordance with an embodiment.

FIG. 10 is a flowchart showing a process for manufacturing the coil-embedded dust core in accordance with the present invention. The coil 1 that is formed by winding the flat conductor 2 is manufactured in advance.

First, a ferromagnetic metal powder and an insulating material are selected according to the required magnetic properties, and they are weighed respectively (step S201). If a cross-linking agent is added, the cross-linking agent is also weighed in step S201.

After weighing out the ferromagnetic metal powder and the insulating material, they are mixed (step S202). When the cross-liking agent is added, the ferromagnetic metal powder, the insulating material, and the cross-linking agent are mixed in step S202. The mixing is performed by using a pressure kneader and preferably at room temperature for 20 to 60 minutes. The resultant mixture is dried preferably at a temperature of about 100 to 300° C. for 20 to 60 minutes (step S203). Next, the dried mixture is disintegrated to obtain ferromagnetic powder for dust core (step S204).

In the succeeding step S205, a lubricant is added to the ferromagnetic powder for dust core. After the lubricant is added, the powder and lubricant are preferably mixed for 10 to 40 minutes.

After the lubricant is added, a compressing step (step S206) is conducted. The compressing step in step S206 is described below with reference to FIG. 11.

FIG. 11 shows a state in which the ferromagnetic powder for dust core, which the lubricant has been added to and mixed with, is compacted by using a die. As shown in FIG. 11, an upper die 5A and a lower die 5B are provided at positions opposed to each other, while a top punch 6 and a bottom punch 7 are provided at positions opposed to each other.

Figure 11A:
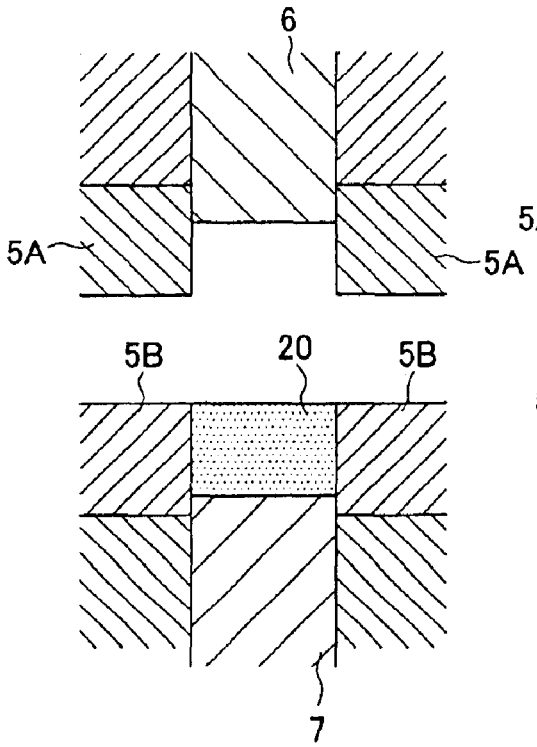
FIGS. 11A to 11D are views for illustrating a compressing step in step S206 of FIG. 10.
Figure 11B:
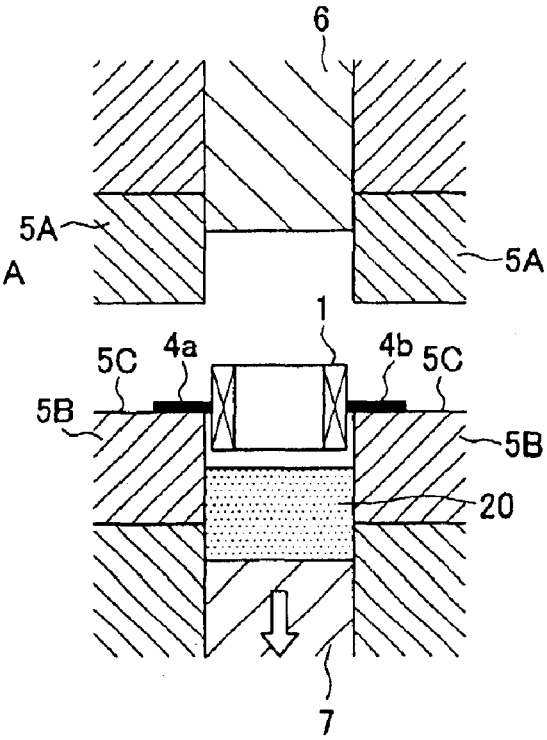

First, in the state shown in FIG. 11A, a mixed powder 20, in which the lubricant has been mixed with the insulation-coated ferromagnetic powder for dust core, is filled into the cavity of the lower die 5B. Next, the bottom punch 7 is lowered, and the coil 1 on which the lead-out end sections 4*a* and 4*b* functioning as the terminal section 100 have been formed, is inserted into the lower die 5B as shown in FIG. 11B. The mixed powder 20 filled into the cavity of the lower die 5B may be preformed before the coil 1 is inserted into the lower die 5B.

As shown in FIG. 11B, when the coil 1 is inserted into the lower die 5B, the coil 1 is positioned horizontally in the lower die 5B without being positioned obliquely. The reason for this is that since the lead-out end sections 4*a* and 4*b* of the coil 1 are formed on the same plane as shown in FIG. 9, the coil 1 can be positioned easily by inserting the lead-out end sections 4*a* and 4*b* so as to fit to a guide 5C of the die.

Figure 11C:
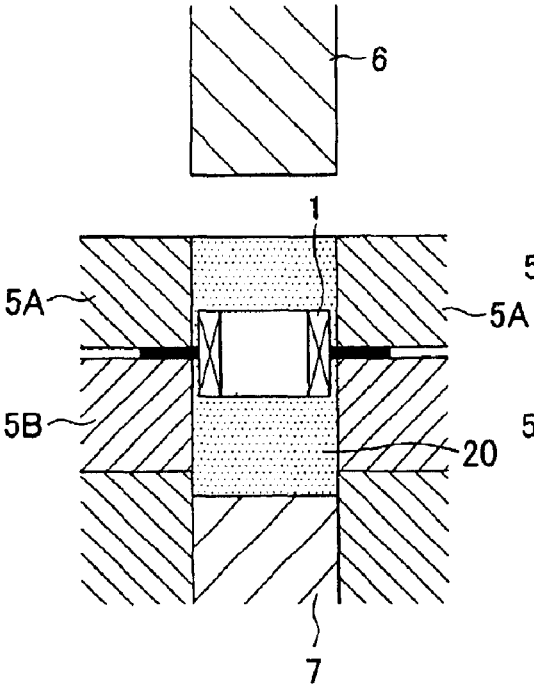
Figure 11D:
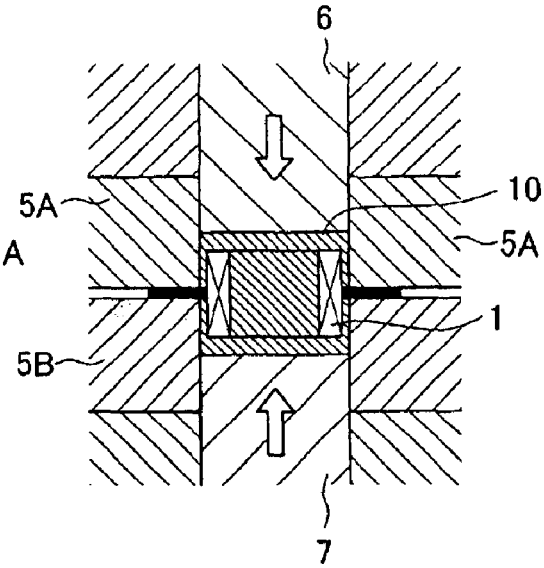

After the coil 1 is inserted into the lower die 5B in FIG. 11B, the upper die 5A is lowered onto the lower die 5B as shown in FIG. 11C, and the mixed powder 20 is charged into the upper die 5A. Next, the top punch 6 is lowered, and a pressure is applied in a state in which the bottom punch 7 is raised as shown in FIG. 11D. As a result, a compacted body consisting of the coil 1 and the green body 10, that is, coil-embedded dust core can be obtained. The desirable pressure application condition is 100 to 600 MPa. It is also desirable to determine the amount of the mixed powder 20 to be filled into the lower die 5B and the amount of the mixed powder 20 to be filled into the upper die 5A so that the position of the coil 1 is in the center of the green body 10.

Figure 12:
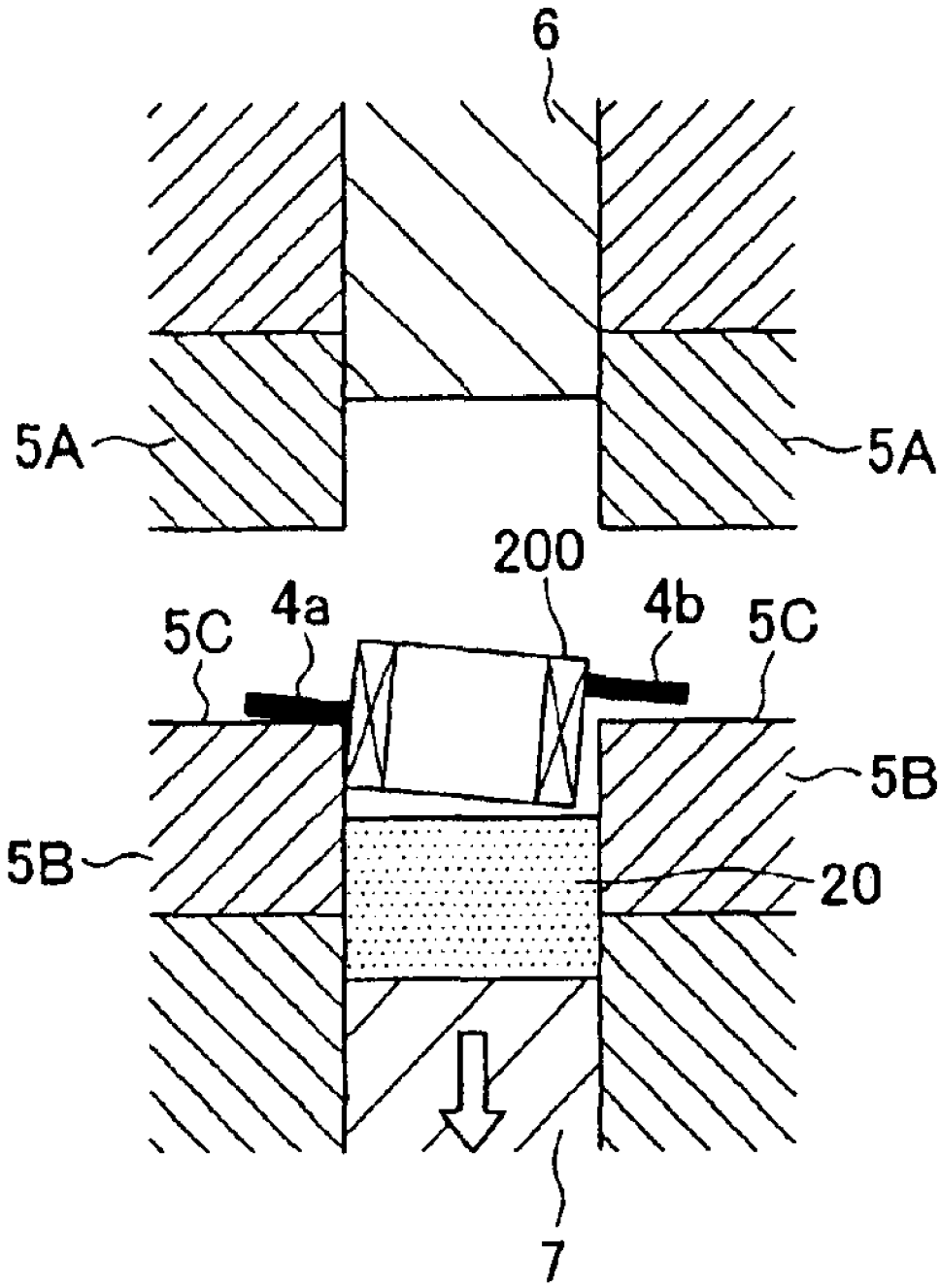
FIG. 12 is a view for illustrating a compressing step in a case where a coil in which lead-out end sections are not formed on the same plane is used.

FIG. 12 shows a state in which a coil 200 in which the lead-out end sections 4*a* and 4*b* are not formed on the same plane is arranged in a die. As shown in FIG. 12, when the lead-out end sections 4*a* and 4*b* are not positioned on the same plane, even if the lead-out end section 4*a* or 4*b* is fitted to the guide 5C of the die, the coil 200 is positioned in the lower die 5B in a state of being oblique. In this case, a portion into which the mixed powder 20 is not filled is produced, so that it is difficult to obtain high inductance. Also, it is finally difficult to arrange the coil 200 in the center of the green body 10. Moreover, it is necessary to control the upper die 5A, lower die 5B, top punch 6, and bottom punch 7 to prevent the coil 200 from being damaged, which results in poor work efficiency.

After the compressing step in step S206 shown in FIGS. 10 and 11, a curing step (heat treatment step) is conducted (step S207). In the curing step, the compacted body obtained in the compressing step (step S206) is kept at temperatures of 150 to 300° C. for 15 to 45 minutes. By doing this, the resin within the compacted body is hardened.

After the curing step, a rust-proofing step is conducted (step S208). Rust-proofing is done by spray coating epoxy resin, for example, on the compacted body consisting of the coil 1 and the green body 10. The thickness of the coat resulting from the spray coating is approximately 15 μm. After rust-proofing, the compacted body is preferably subjected to heat treatment at 120 to 200° C. for 15 to 45 minutes.

As described above, in the coil-embedded dust core in accordance with this embodiment, a part of the coil 1 is used as the terminal section 100. However, the conductor 2 used in the coil-embedded dust core has an insulation film such as an enamel film formed on the surface thereof to begin with. According to the observation made by the inventors, a copper oxide film is formed directly underneath the insulation film in the curing step in step S207. Further, a paint film is formed on the insulation film through the rust-proofing step (step S208). These films formed on the terminal section 100 are removed in a sandblasting step (step S209).

One way to remove the three layers of films formed on the surface of the coil 1 is to corrode them with chemicals. However, because different chemicals are required to remove different films, several treatments must be rendered in order to remove the three layers of films. In addition, the chemical corrosion method requires heating of the chemicals, which entails a risk of alkaline particles or acidic particles attaching to the paint film or the insulation film of the terminal section 100 when the chemicals are heated. Such attachment would result in progressive corrosion of the paint film or the insulation film over a long period of time, which is likely to cause lowered rust-proofing efficiency or a short circuit between the coil layers. To avoid such a risk, there is available a mechanical removing method using a tool. However, a tool that may damage the copper part of the conductor 2, cannot be used because the thickness of the terminal section 100 of the coil-embedded dust core in accordance with this embodiment is about 5 mm or smaller (about 0.1 to 0.3 mm). Consequently, in this embodiment, a method for removing the three layers of films by sandblasting is used.

When the terminal section 100 is to be surface mounting terminal section, the terminal section 100 is soldered (step S210). Thereafter, it would be convenient to bend the terminal section 100 which has become wide through flattening process, as necessary when mounting the coil-embedded dust core on a substrate. In that case, terminal section 100 is bent along the side of the green body 10.

The following effects may be obtained from the coil-embedded dust core according to this embodiment.

(1) Because the coil 1 is formed by winding the flat conductor 2, high inductance can be obtained with a small number of turns. Also, a compact (low in height) coil-embedded dust core measuring 5 to 15 mm long by 5 to 15 mm wide by 2 to 5 mm thick can be obtained.

(2) Because the lead-out end section 4*a*, 4*b*, which is a part of the coil 1, is used as the terminal section 100, there is no need for forming a connection part between the coil 1 and the terminal section. Therefore, problems of joint failure and insulation failure caused by the connection part can be solved.

(3) Because the lead-out end sections 4*a* and 4*b* are formed on the same plane, positioning can be performed easily and exactly when the coil 1 is arranged in the die. Thereby, the mixed powder 20 can be filled uniformly, so that the inductance value varies less.

(4) Because the lead-out end section 4*a*, 4*b*, which is a part of the coil 1, is used as the terminal section 100, there is no need for preparing a terminal section separately. Therefore, the number of parts can be decreased.

(5) The coil 1 is embedded within the green body 10 without using any spool. Consequently, there is no gap between the coil 1 and the magnetic core, and this leads to such electronic components as compact (low in height) inductor with high inductance.

(6) Because the green body 10 is used, the DC bias characteristics that accommodate large current are superior and the magnetic properties are stable.

EXAMPLE

The coil-embedded dust core in accordance with the present invention will be described in detail by using an example.

An experiment conducted to ascertain the inductance value of the coil-embedded dust core in the case where the coil 1 in which the lead-out end sections 4*a* and 4*b* are formed on the same plane by bending and the coil 200 in which the lead-out end sections 4*a* and 4*b* are not formed on the same plane are used is explained as the example. Both of the coil 1 and the coil 200 are formed by winding the conductor 2 2.5 turns.

Twenty samples of the coil-embedded dust core were made according to the following procedure:

The following were prepared:

Magnetic powder: Permalloy powder manufactured through atomizing method (45% Ni—Fe; mean particle size 25 μm)

Insulating material: silicone resin (SR2414LV by Toray Dow Corning Silicone Co., Ltd.)

Cross-linking agent: organic titanate (TBT B-4 by NIPPON SODA CO., LTD.)

Lubricant: aluminum stearate (SA-1000 by Sakai Chemical Industry)

Next, 2.4 wt % of the insulating material and 0.8 wt % of the cross-linking agent were added to the magnetic powder, and these were mixed for 30 minutes at room temperature using a pressure kneader. Following this, the mixture was exposed to air and dried for 30 minutes at 150° C., thereafter 0.4 wt % of the lubricant was added to the dried magnetic powder and mixed for 15 minutes in a V mixer.

Subsequently, compressing was performed by the procedure shown in FIGS. 11A to 11D, by which 20 coil-embedded dust core samples were made. Of these 20 coil-embedded dust core samples, for 10 samples, the coil 1 in which the lead-out end sections 4*a* and 4*b* are formed on the same plane was inserted in FIG. 11B. For the remaining 10 samples, the coil 200 in which the lead-out end sections 4*a* and 4*b* are not formed on the same plane was inserted in FIG. 11B. The pressure in FIG. 11D was set at 140 MPa for all samples. The core dimensions were 12.5 mm long by 12.5 mm wide by 3.3 mm thick.

Of the 20 samples, sample Nos. 1 to 10 used the coil 200 in which the lead-out end sections 4*a* and 4*b* are not formed on the same plane, and sample Nos. 11 to 20 used the coil 1 in which the lead-out end sections 4*a* and 4*b* are formed on the same plane by bending. The inductance values of sample Nos. 1 to 10 are given in Table 1, and those of sample Nos. 11 to 20 are given in Table 2. "0A", "10A" and "20A"

shown in Tables 1 and 2 designate the values of direct current superposed on an inductance measuring AC signal (0.05 V, 100 kHz).

TABLE 1

| Sample No. | Inductance value (μH) 0A | 10A | 20A |
|---|---|---|---|
| 1 | 0.589 | 0.550 | 0.519 |
| 2 | 0.595 | 0.568 | 0.549 |
| 3 | 0.646 | 0.616 | 0.590 |
| 4 | 0.591 | 0.568 | 0.564 |
| 5 | 0.647 | 0.604 | 0.562 |
| 6 | 0.726 | 0.687 | 0.653 |
| 7 | 0.652 | 0.620 | 0.601 |
| 8 | 0.688 | 0.656 | 0.625 |
| 9 | 0.653 | 0.623 | 0.602 |
| 10 | 0.709 | 0.655 | 0.599 |
| Mean value | 0.650 | 0.615 | 0.586 |
| MAX | 0.726 | 0.687 | 0.653 |
| MIN | 0.589 | 0.55 | 0.519 |
| MAX − MIN | 0.137 | 0.137 | 0.134 |

TABLE 2

| Sample No. | Inductance value (μH) 0A | 10A | 20A |
|---|---|---|---|
| 11 | 0.776 | 0.715 | 0.648 |
| 12 | 0.791 | 0.729 | 0.657 |
| 13 | 0.782 | 0.724 | 0.651 |
| 14 | 0.789 | 0.726 | 0.653 |
| 15 | 0.779 | 0.718 | 0.652 |
| 16 | 0.786 | 0.727 | 0.649 |
| 17 | 0.777 | 0.715 | 0.649 |
| 18 | 0.786 | 0.725 | 0.653 |
| 19 | 0.789 | 0.727 | 0.655 |
| 20 | 0.781 | 0.724 | 0.650 |
| Mean value | 0.784 | 0.723 | 0.652 |
| MAX | 0.791 | 0.729 | 0.657 |
| MIN | 0.776 | 0.715 | 0.648 |
| MAX − MIN | 0.015 | 0.014 | 0.009 |

As shown in Table 1, it is found that sample Nos. 1 to 10 using the coil 200 in which the lead-out end sections 4*a* and 4*b* are not formed on the same plane has a large variation in inductance. Specifically, in the case of alternating current only (in the case where the superposed direct current is 0A), the inductance value of sample No. 6 is 0.726 μH, while the inductance value of sample No. 1 is 0.589 μH, the difference being 0.137 μH.

On the other hand, as shown in Table 2, sample Nos. 11 to 20 using the coil 1 in which the lead-out end sections 4*a* and 4*b* are formed on the same plane has a small variation in inductance. In the case of alternating current only, all samples exhibit an inductance value not lower than 0.7 μH. Also, sample Nos. 11 to 20 has a mean value of 0.784 μH in the case of alternating current only, while sample Nos. 1 to 10 has a mean value of 0.650 μH in the case of alternating current only, there occurring a difference in mean value not lower than 0.1 μH.

Also, from Tables 1 and 2, it can be seen that even in the case where a direct current of 10A or 20A is superposed, the same tendency as in the case of alternating current is exhibited. Specifically, sample Nos. 1 to 10 using the coil 200 that is not subjected to bending has a large variation in inductance, while sample Nos. 11 to 20 using the coil 1 in which the lead-out end sections 4*a* and 4*b* are formed on the same plane by bending has a small variation in inductance and superior DC bias characteristics.

From the above-described results, it was found that the coil-embedded dust core using the coil 1 in which the lead-out end sections 4*a* and 4*b* are formed on the same plane exhibits a high inductance value and excellent DC bias characteristics, and also has a small variation in inductance. The reason for this is presumed to be that by forming the lead-out end sections 4*a* and 4*b* functioning as the terminal section 100 on the same plane, the arrangement of the coil 1 is made easily when the coil-embedded dust core is manufactured, and the positioning thereof is performed exactly (see FIG. 11B). Contrarily, the reason why the inductance varies in the case where the coil 200 in which the lead-out end sections 4*a* and 4*b* are not formed on the same plane is used, is thought to be as described below. In the case where the coil 200 in which the lead-out end sections 4*a* and 4*b* are not formed on the same plane is used, the coil 200 becomes oblique at the time of compressing, so that the mixed powder 20 is filled into the die ununiformly and hence a portion into which the mixed powder 20 is not filled is produced. Thereby, the variations in dimensions and density after compressing are made large, which possibly leads to varied inductance and decreased inductance value.

While the description above refers to embodiments and examples of the present invention, it will be understood that various modifications and changes may be made without limiting thereto within the range of the claims.

As described above, according to the present invention, a coil-embedded dust core can be made even more compact and with larger inductance of good accuracy.

What is claimed is:

1. A coil-embedded dust core comprising:

a coil including a winding section, in which a flat conductor having front and back surfaces opposed to each other with a predetermined distance, is wound;

a first end section which is formed by said conductor and is extended from said winding section;

a second end section which is formed by said conductor and is extended from said winding section at a position different from said first end section, with said winding section being insulation coated; and a green body which is formed of insulation-coated ferromagnetic metal particles and in which said coil is embedded, wherein either one of said front and back surfaces of said first end section and either one of said front and back surfaces of said second end section are formed so as to be on the same plane.

2. The coil-embedded dust core according to claim 1, wherein said conductor is formed by a rectangular wire.

3. The coil-embedded dust core according to claim 1, wherein said first and second end sections are thinner than said flat conductor which constitutes the winding section.

4. The coil-embedded dust core according to claim 1, wherein said first and second end sections are extended substantially in parallel with said conductor in said winding section.

5. The coil-embedded dust core according to claim 1, wherein at least one of said first and second end sections has a bent section having a predetermined angle with respect to said winding section.

6. The coil-embedded dust core according to claim 1, wherein said ferromagnetic metal particles forming said green body is composed of an Fe—Ni system alloy.

7. The coil-embedded dust core according to claim 1, wherein the winding section has a circular configuration.

8. A coil-embedded dust core, comprising:

a green body formed of ferromagnetic metal particles coated with an insulating material and a coil which is embedded in said green body, wherein said coil includes a winding section in which a flat conductor being insulation coated, is wound;

a pair of terminal sections formed by extending said conductor forming said winding section; and distances from a predetermined reference plane to said paired terminal sections are made substantially equal.

9. The coil-embedded dust core according to claim 8, wherein said paired terminal sections are extended from said winding section in a direction different from each other.

10. The coil-embedded dust core according to claim 8, wherein said paired terminal sections are formed so as to be wider than other sections of said coil.

11. The coil-embedded dust core according to claim 8, wherein a part or all of each of said paired terminal sections is exposed to the outside of said green body.

12. The coil-embedded dust core according to claim 8, wherein the winding section has a circular configuration.

13. A coil for a coil-embedded dust core, comprising:

a winding section in which a flat conductor having front and back surfaces opposed to each other with a predetermined distance, is wound;

a first end section which is formed by said conductor and is extended from said winding section; and a second end section which is formed by said conductor and is extended from said winding section at a position different from said first end section, wherein either one of said front and back surfaces of said first end section and either one of said front and back surfaces of said second end section are formed so as to be on the same plane.

14. The coil for a coil-embedded dust core according to claim 13, wherein said first and second end sections are extended to symmetrical positions with respect to said winding section.

* * * * *